US008302705B2

(12) United States Patent
Downton

(10) Patent No.: US 8,302,705 B2
(45) Date of Patent: Nov. 6, 2012

(54) STEERING SYSTEM

(75) Inventor: Geoff Downton, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 438 days.

(21) Appl. No.: 11/958,538

(22) Filed: Dec. 18, 2007

(65) Prior Publication Data

US 2008/0149394 A1 Jun. 26, 2008

(30) Foreign Application Priority Data

Dec. 21, 2006 (GB) ..... 0625385.0

(51) Int. Cl.
*E21B 7/20* (2006.01)
*E21B 7/06* (2006.01)
*E21B 7/08* (2006.01)

(52) U.S. Cl. ..... 175/74; 175/61; 175/73; 175/75; 175/76

(58) Field of Classification Search ..... 175/45, 175/61, 74, 76, 75, 73
See application file for complete search history.

(56) References Cited

U.S. PATENT DOCUMENTS

| | | | | |
|---|---|---|---|---|
| 5,139,094 | A * | 8/1992 | Prevedel et al. | 175/61 |
| 6,216,802 | B1 * | 4/2001 | Sawyer | 175/73 |
| 6,513,606 | B1 | 2/2003 | Krueger | |
| 2003/0127252 | A1 * | 7/2003 | Downton et al. | 175/73 |
| 2005/0109542 | A1 * | 5/2005 | Downton | 175/73 |
| 2007/0163810 | A1 * | 7/2007 | Underwood et al. | 175/61 |

FOREIGN PATENT DOCUMENTS

WO WO 03/052237 6/2003

* cited by examiner

*Primary Examiner* — Cathleen Hutchins
(74) *Attorney, Agent, or Firm* — Chadwick A. Sullivan

(57) ABSTRACT

A downhole steering system comprises a first full gauge stabilizer 34, a bias unit 28, a universal joint 26, and a second full gauge stabiliser 22, the bias unit 28 and universal joint 26 being located between the first and second full gauge stabilizers 34, 22. The system further comprises a drill bit 10 and a fluid powered downhole motor 14, the motor being located, at least partially, between the drill bit 10 and the second stabilizer 22.

11 Claims, 1 Drawing Sheet

STEERING SYSTEM

BACKGROUND TO THE INVENTION

This invention relates to a steering system, and in particular to a steering system intended for use in a downhole environment in the formation of a borehole.

Steering systems for use in downhole environments typically fall into two groups. In one type of steering system, a downhole motor and drill bit are secured to the remainder of the downhole assembly and drill string through an angled component so that the axis of rotation of the drill bit is angled relative to the axis of the adjacent part of the borehole. In normal use, the drill string rotates with the result that the drilling direction constantly changes, the net result of which is to form a generally straight or spiraling borehole. However, if it is desired to drill a dog leg or curve, the drill string is held against rotation with the drill bit pointing in the direction in which the curve is to be formed. After formation of the curve, rotation of the drill string at a generally uniform speed recommences so as to drill a generally straight borehole region.

In the second type of system, a downhole bias unit is provided to allow the application of a biasing side load to the drill bit to form a curve in the borehole. The bias unit typically comprises a housing on which a plurality of bias pads are mounted, each pad being moveable between retracted and extended positions by respective actuators. By appropriate control of which pad or pads are in engagement with the wall of the borehole being drilled at any given time, the direction in which the biasing side load is applied can be controlled.

SUMMARY OF THE INVENTION

According to the invention there is provided a downhole steering system comprising a first (or upper) full gauge stabiliser, a bias unit, a universal joint, and a second (or lower) full gauge stabiliser and a bit, the bias unit and universal joint being located between the first and second full gauge stabilisers.

It has been found that, when operated so that the axis of the bias unit lies on the centreline of the borehole, then the steering system can be used to form a curve or spiral of generally constant radius of curvature. Movement of the bias unit away from this central position results in the increase or decrease of the curvature, depending upon the direction in which the bias unit is shifted. Subsequent movement of the bias unit so as to lie on the centreline results in drilling again occurring at a constant radius of curvature.

As the bias unit need only be actuated to hold it at a position in which it is not on the centreline of the borehole at times when a change in the radius of curvature being drilled is desired, the downhole steering system can operate more efficiently than in prior arrangements.

Although the steering system will operate in a number of other conditions, preferably the steering system satisfies the equation:

$$L3*(L3+L4)=L2*(L1+L2)$$

where L1 is the separation of a drill bit attached to the steering system from the lower stabiliser (i.e. the one closet the bit)—by normal convention;

L2 is the separation of the lower stabiliser from the universal joint;

L3 is the separation of the universal joint from the bias unit actuators; and L4 is the separation of the bias unit from the upper stabiliser.

The steering system is conveniently used in conjunction with a drill bit and a downhole motor. The universal joint may be replaced with a flexible collar. Conveniently the downhole motor is a fluid driven downhole motor which, preferably, is located at least partially, between the lower full gauge stabiliser and the drill bit (this stabiliser would be near the lower end of the motor—probably on it).

Such location of the motor, and the use of a motor of this type, is advantageous in that the bias unit need not rotate at the drilling speed, in use, resulting in a significant reduction in wear. The azimuth and inclination of the drill bit can be determined in many ways for example, by using sensors associated with the universal joint measuring the bend therein, in combination with collar rotational sensors and inclination and azimuth data representative of the position of the bias unit, and this information can be used by the control unit of the bias unit in controlling the operation of the system. The inclination and azimuth sensors could also be placed below the universal joint and the information transmitted across the joint to the control unit and combined with sensors in the control unit and/or measurements of the UJ bend angles.

In other aspects the invention relates to a steering system where the upper and lower collars contain additional stabiliser elements designed to limit the upper magnitude of the curvature formed to cope as may be required to cope with failure conditions Or where the bias unit's displacement actuation system is designed to fail safe into a central (constant curvature) position.

Or where the diameter of the borehole is measured and that information used to control the extent of bias unit actuator pad movement Or where the universal joint contains limit stops to limit the upper magnitude of the curvature.

Or where the universal joint comprises dampening materials to reduce the effects of vibration

BRIEF DESCRIPTION OF THE DRAWINGS

The invention will further be described, by way of example, with reference to the accompanying drawings, in which.

DETAILED DESCRIPTION OF THE DRAWINGS

Figure 1:
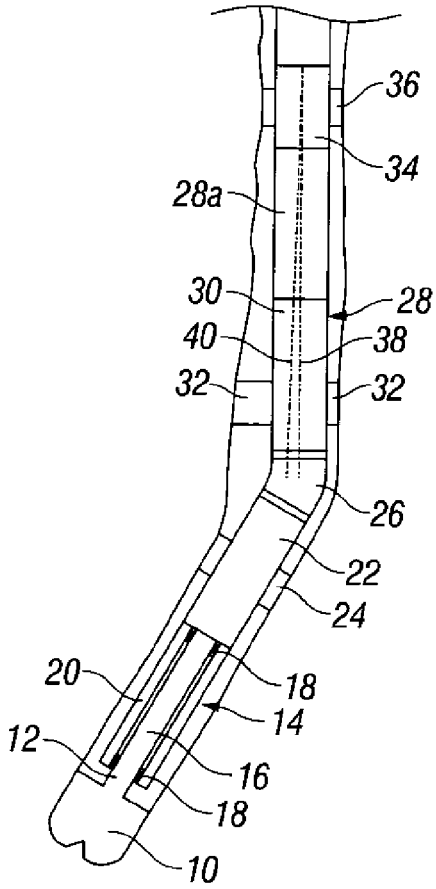
FIG. 1 is a diagrammatic view illustrating a steering system in accordance with one embodiment of the invention.

Referring firstly to FIG. 1 there is shown, in diagrammatic form (i.e. many details of the system have been simplified whilst retaining the primary intent of the invention), part of a steerable drilling system, in use. The drilling system comprises a rotary drill bit 10 mounted on the drive shaft 12 of a downhole motor 14. The downhole motor 14 is a fluid driven motor and comprises a rotor 16 supported through bearings 18 for rotation within a stator 20. The external surface of the rotor 16 and the inner surface of the stator 20 are each shaped to include formations, for example of generally helical form, which co-operate with one another to define a series of isolated cavities, the positions of which move along the length of the motor as the rotor 16 rotates in a given direction relative to the stator 20. A progressive cavity motor of this type is sometimes referred to as a Moineau motor.

The stator 20 of the motor 14 is connected to a lower full gauge stabiliser 22 having stabiliser pads 24 which are adapted to engage the surrounding formation. The lower full gauge stabiliser 22 will be referred to hereinafter as the second stabiliser.

The second stabiliser 22 is connected to a universal joint 26 which, in turn, is connected to a bias unit 28. The bias unit 28 includes a housing 30 upon which a plurality of bias pads 32 are mounted. The bias pads 32 are each mounted so as to be moveable between a radially retracted position (as shown in the right hand side of FIG. 1) and a radially extended position (as shown on the left hand side of FIG. 1). Movement of the bias pads 32 is achieved by means of actuator pistons (not shown) to which drilling fluid or mud under pressure can be supplied, when desired, through a suitable arrangement.

The bias unit 28 includes a control unit 28*a* which receives signals representative of the current drilling conditions and the position of the drilling system, and controls the bias unit 28 so as to steer the system in a desired drilling direction. In one known bias unit suitable for use in this application the control unit includes a rotary valve arranged to control the supply of fluid under pressure to the actuators associated with the bias pads so as to control the positions occupied by the pads. By extending and retracting the pads in turn (as the bias unit rotates) at a speed different to the speed of rotation of the bias unit, the extension and retraction of the bias pads can be used to hold the bias unit generally centrally within the borehole. If the extension and retraction of the pads occurs at the same speed as the speed of rotation of the bias unit, then the pads will always occupy their extended position when located at the same side of the bias unit in space, thereby applying a laterally acting side load to the bias unit resulting in the bias unit occupying an eccentric position in the borehole. Although this type of bias unit and associated control unit may be used, it will be appreciated that the invention is not restricted to the use of this type of control unit and bias unit, but rather that other types of control unit and bias unit may be used. The control units may be of the roll-stabilised type or of the strapdown type. The bias unit may also be of the non-rotating sleeve variety where the displacement actuators are situated in a non-rotating sleeve that advances along the borehole by sliding. Further, rather than use a rotary valve in the control unit, a plurality of individually controllable valves may be provided to control the operation of the actuators associated with the pads, the individually controllable valves taking the form of, for example, solenoid actuated valves.

The bias unit 28 is secured to an upper full gauge stabiliser 34 having stabiliser pads 36 urged into engagement with the adjacent formation. The upper full gauge stabiliser unit 34 will be referred to hereinafter as the first stabiliser.

The first stabiliser 34 is connected to a drill string to support each of the components referred to hereinbefore. The drill string may also drive the various components for rotation, the rotary drive of the drill string being transmitted through the universal joint 26 to the components located below the universal joint. Further, drilling fluid is supplied through the drill string to the various components, the supply of fluid to the motor 14 causing the rotor 16 to rotate relative to the stator 20 and thereby rotating the drill bit 10. The rotation of the drill bit 10 in combination with the load applied thereto causes the bit 10 to gouge, scrape or abrade material from the formation, which material is carried away by the flow of drilling fluid.

The points at which the first stabiliser 34 and the bias unit 28 engage or are engageable with the wall of the borehole are separated by a distance L4. The point at which the bias unit 28 engages the wall is separated from the universal joint 26 by a distance L3. The universal joint 26 is separated from the point at which the second stabiliser 22 engages the wall of the borehole by a distance L2. The second stabiliser 22 and drill bit 10 are separated by a distance L1.

The lengths L1, L2, L3 and LA preferably satisfy the equation:

$$L3*(L3+L4)=L2*(L1+L2)$$

In use, a drilling system satisfying this equation will tend to form a borehole with a constant rate of change of curvature (i.e. with dimensional units equivalent to deg/100 ft/ft. Note: that the curvature of a borehole is proportional to the inverse of its radius-of-curvature) Controlling the drilling system so that a centreline 38 of the bias unit 28 is aligned with the centreline 40 of the adjacent part of the borehole will cause the drilling system to form a borehole of constant curvature. By varying the curvature, a change in drilling direction can be attained, and this can be achieved by controlling the bias unit 28 to urge the pads thereof into engagement with the adjacent formation to tilt the bias unit 28 about the first stabiliser 34 and move the centreline 38 of the bias unit 28 out of alignment with that of the adjacent part of the borehole. The shift in the position of the bias unit 28, in combination with the presence of the second stabiliser 22 and The universal joint 26 causes a change in the orientation of the motor 14 and drill bit 10, thereby changing the curvature of the borehole being formed. Once the change in curvature of the borehole to achieve drilling in the desired direction has been attained, the bias unit 28 is again controlled so as to lie generally coaxially with the adjacent part of the borehole so as to return the system to a condition in which the spiral borehole being formed is of uniform curvature. The present invention provides a drilling system where the rate of change of curvature of the hole is controlled by the linear displacement of a bias unit pad (adjacent to a universal joint or flexible member) deflecting the centre line of the bias unit away from the centre line of the hole such that the magnitude of the rate of change of the curvature of the hole is linearly related to the magnitude and sense of this displacement. The system is controlled and stabilised using at least one sensor placed above or below or on the universal joint or flexible member In one form of the invention the displacement of the bias unit's linear actuator is measured and controlled to computed values require to achieve the desired trajectory In one form of the invention displacement of the bias unit's linear actuator is implicitly imposed by limit stops and the system steers by switching between these limits In one form of the invention additionally at least one stabiliser is made adjustable in gauge.

In one form of the invention the universal joint/flexible member is designed to transmit and react axial torques.

A significant advantage of using a steering system of forms of this invention is that, other than when a change in radius of curvature or drilling direction is desired, the bias unit need not be driven to hold it in an eccentric position relative to the borehole. The steering system can thus be of good efficiency. Where the bias unit is of the type described hereinbefore, the improved efficiency may be reflected in a reduction in the required supply of fluid under pressure necessary to operate the bias unit depending upon the nature of the control system used to supply the fluid to the actuators of the bias unit.

Although it is preferred for the above equation to be satisfied, some advantages may still be seen where the value of L3*(L3+L4) varies from L2*(L1+L2) by only a small amount, say by less than about ±5%.

It has been found that a steering system of this type displays a predictable rate of change of curvature response of $$\frac{6*E}{L2*L4(L3+L2)*(L1+L2)*(L1+L2+L3)}(L3)(L3+L4)$$

where E is the displacement of the centreline of the bias unit from the centreline of the borehole.

Figure 2:
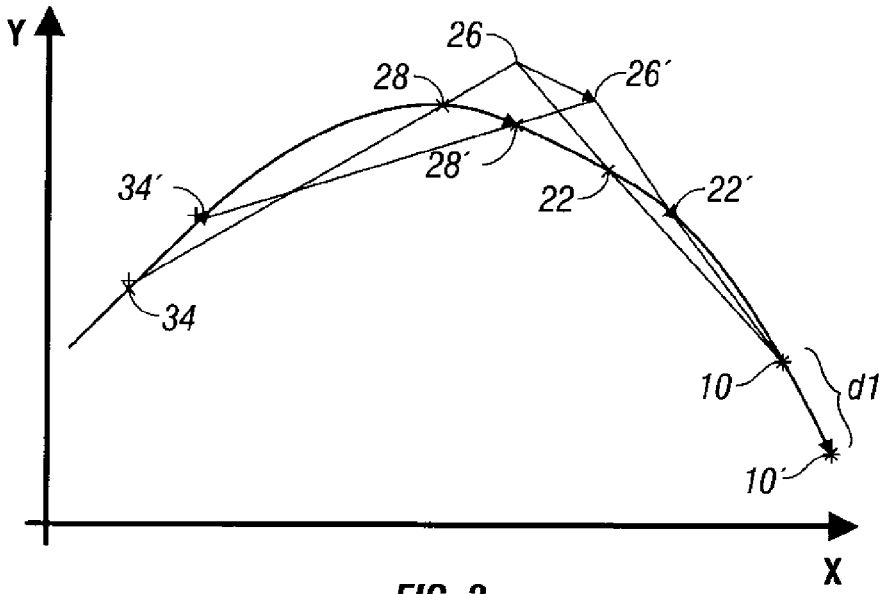
FIG. 2 is a graph illustrating the operation of the system shown in FIG. 1.

It has further been found that changes in the gauge size of the second stabiliser can play a significant role in the operation of the steering system, and as a result in operation $$E > \frac{U*L3*L4}{L1*L2}$$

where U is the under gauge (effect) of the second stabiliser. To achieve this condition the gauge of this stabiliser may also be made adjustable in diameter to ensure the above condition is alway preserved. It will be understood that ideally U should be as small as practically possible. FIG. 2 illustrates, diagrammatically, the system in a first position at a first time, and a second position at a later time, the bit 10 having advanced by a distance of d1 during this time to the position indicated by reference numeral 10'. The corresponding movement of second stabiliser 22, universal joint 26, bais unit 28, and first stabiliser 34 is shown by the new positions of these components labeled with reference numbers 22', 26', 28' and 34', respectively.

It will be appreciated that the curve followed by or produced using the system is dependent upon a number of factors including the distances by which the bias pads 32 are extended, and the relative distances between the first stabiliser 34 and the universal joint 26, and between the universal joint 26 and the second stabiliser 22, as mentioned hereinbefore, which are fixed for a given design of steering system.

As mentioned hereinbefore, the use of a mud powered motor 14 is advantageous in that the motor 14 can be located between the second stabiliser 22 and the bit 10 without having to pass control lines around or through the universal joint 26. Such location has the advantage that the bias unit 28 is rotated only at the drill string speed rather than at the speed of rotation of the drill bit resulting in a significant reduction in wear to the pads 32 of the bias unit 28 as well as the associated control systems and actuators.

If desired, appropriate sensors may be provided in the universal joint to allow determination of the inclination and azimuth of the second stabiliser 22, motor 14 and bit 10. The outputs of these sensors may then be used by the control unit of the bias unit in the control of the steerable system.

It will be appreciated that, although FIG. 1 illustrates the steering system in a generally vertical configuration, this need not be the case and the system could be used in boreholes extending in other directions and, in the description hereinbefore, references to upper, lower, above and below, and the like, should be interpreted accordingly.

Although a specific arrangement has been described hereinbefore it will be appreciated that a number of modifications or alterations are possible within the scope of the invention. For example, the second stabiliser could be made integral with the motor, if desired, in which case only part of the motor rather than all of the motor may be located between the second stabiliser and the drill bit. Although there is great virtue is having the motor below the UJ this invention also allows for it to be placed above the UJ.

The invention claimed is:

1. A downhole steering system comprising a first full gauge stabiliser at an uphole position, a bias unit having bias pads mounted for radial movement between radially retracted and radially extended positions, the radially extended positions being selected to place the bias pads in contact with a surrounding wellbore wall, a universal joint, and a second full gauge stabiliser at a downhole position, the bias unit and universal joint being located between the first and second full gauge stabilisers, the bias unit being operable to control the position of a centerline thereof relative to a centerline of an adjacent part of the borehole being formed to control the radius of curvature thereof; the bias unit located between the first full gauge stabiliser and the universal joint.

2. The system according to claim 1, further comprising a drill bit and a downhole motor.

3. The system according to claim 2, wherein the downhole motor is a fluid driven downhole motor.

4. The system according to claim 2, wherein the downhole motor is located, at least partially, between the second full gauge stabiliser and the drill bit.

5. The system according to claim 2, approximately satisfying the equation $$L3*(L3+L4)\approx L2*(L1+L2)$$

where L1 is the separation of the second stabiliser from the drill bit;

L2 is the separation of the universal joint from the second stabiliser;

L3 is the separation of the bias unit from the universal joint; and

L4 is the separation of the bias unit from the first stabiliser.

6. The system according to claim 5, wherein the equation $$L3*(L3+L4)=L2*(L1+L2)$$

is satisfied.

7. The system according to any one of the preceding claims, wherein a borehole of substantially uniform radius of curvature is formed when the bias unit centerline lies on the centerline of the borehole, movement of the bias unit from this position causing a change in the radius of curvature of the borehole being formed.

8. A downhole steering system comprising a first full gauge stabilizer at an uphole position, a bias unit, a universal joint, a second full gauge stabiliser at a downhole position, and a downhole motor, the bias unit and universal joint being located between the first and second full gauge stabilisers, the bias unit being operable to control the position of a centerline thereof relative to a centreline of an adjacent part of the borehole being formed, the bias unit having bias pads selectively reciprocable between a radially retracted position and a radially extended position contacting a surrounding wellbore wall to control the radius of curvature thereof, the downhole motor being disposed between the second full gauge stabiliser and a drill bit; the bias unit located between the first full gauge stabiliser and the universal joint.

9. The system according to claim 8, approximately satisfying the equation $$L3*(L3+L4)\approx L2*(L1+L2)$$

where L1 is the separation of the second stabiliser from the drill bit;

L2 is the separation of the universal joint from the second stabiliser;

L3 is the separation of the bias unit from the universal joint; and

L4 is the separation of the bias unit from the first stabiliser.

10. The system according to claim 9, wherein the equation $$L3*(L3+L4)\approx L2*(L1+L2)$$

is satisfied.

11. The system according to claim 8, wherein a borehole of substantially uniform radius of curvature is formed when the bias unit centerline lies on the centerline of the borehole, movement of the bias unit from this position causing a change in the radius of curvature of the borehole being formed.

* * * * *